US006553907B2

(12) United States Patent
Richards

(10) Patent No.: US 6,553,907 B2
(45) Date of Patent: Apr. 29, 2003

(54) MULTI-COLOR PRINTING PRESS WITH COMMON BLANKET CYLINDER

(75) Inventor: John Sheridan Richards, Barrington, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/211,747

(22) Filed: Aug. 2, 2002

(65) Prior Publication Data

US 2002/0178945 A1 Dec. 5, 2002

Related U.S. Application Data

(62) Division of application No. 09/625,623, filed on Jul. 26, 2000, now Pat. No. 6,474,231.

(51) Int. Cl.[7] ..... B41M 1/14

(52) U.S. Cl. ..... 101/211; 101/181; 101/247; 101/177

(58) Field of Search ..... 101/181, 211, 101/137, 177, 178, 179, 180, 182, 183, 184, 217, 219, 350.2, 247

(56) References Cited

U.S. PATENT DOCUMENTS

| | | | | | |
|---|---|---|---|---|---|
| 1,168,651 | A | * | 1/1916 | Kraus | 101/178 |
| 2,764,933 | A | * | 10/1956 | Hargrave | 101/177 |
| 3,190,218 | A | * | 6/1965 | Willard | 101/182 |
| 4,231,291 | A | * | 11/1980 | Davidson, Jr. et al. | 101/137 |
| 4,491,070 | A | * | 1/1985 | Fischer | 101/181 |
| 4,854,232 | A | * | 8/1989 | Oda | 101/211 |
| 4,934,265 | A | * | 6/1990 | Knauer | 101/177 |
| 4,936,211 | A | * | 6/1990 | Pensavecchia et al. | 101/177 |
| 5,031,530 | A | * | 7/1991 | Burger | 101/211 |
| 5,063,844 | A | * | 11/1991 | Fausel | 101/247 |
| 5,304,267 | A | * | 4/1994 | Vrotacoe et al. | 156/86 |
| 5,363,762 | A | * | 11/1994 | Belanger | 101/177 |
| 5,636,573 | A | * | 6/1997 | Brennan | 101/211 |
| 5,806,426 | A | * | 9/1998 | Choulet | 101/211 |
| 5,842,414 | A | * | 12/1998 | Yoshida et al. | 101/177 |
| 5,907,997 | A | * | 6/1999 | Jackson et al. | 101/180 |
| 5,909,708 | A | * | 6/1999 | Bolza-Schünemann | 101/177 |
| 5,960,713 | A | * | 10/1999 | De Moore et al. | 101/137 |
| 5,970,865 | A | * | 10/1999 | Horth et al. | 101/490 |
| 6,062,136 | A | * | 5/2000 | Bolza-Schünemann | 101/135 |
| 6,101,944 | A | * | 8/2000 | Schmid et al. | 101/467 |
| 6,220,156 | B1 | * | 4/2001 | Rohloff | 101/177 |
| 6,425,326 | B1 | * | 7/2002 | Dorenkamp et al. | 101/351.1 |
| 6,435,086 | B1 | * | 8/2002 | Rendleman et al. | 101/177 |

FOREIGN PATENT DOCUMENTS

| | | | |
|---|---|---|---|
| DE | 3917340 | * | 11/1990 |

* cited by examiner

*Primary Examiner*—Eugene H. Eickholt
(74) *Attorney, Agent, or Firm*—Davidson, Davidson &Kappel, LLC

(57) ABSTRACT

A multi-color printing press comprising a first print form cylinder; second print form cylinder; at least one first inking unit for inking the first and second print form cylinders; third print form cylinder; fourth print from cylinder; at least one second inking unit for inking the third and fourth print form cylinders with an ink color different from the at least one first hiking unit; a common blanket cylinder, the first and third print form cylinders contacting the common blanket cylinder during a first mode of operation and the second and fourth print form cylinders contacting the common blanket cylinder during a second mode of operation. A method for printing material comprising the steps of transferring ink from a first inking unit to a blanket cylinder through a first printing form, transferring ink from a second inking unit to the blanket cylinder through a third printing form, moving the first and third printing forms away from the blanket cylinder, transferring ink from the first inking unit to the blanket cylinder through a second printing form, and transferring ink from the second inking unit to the blanket cylinder through a fourth printing form.

4 Claims, 2 Drawing Sheets

MULTI-COLOR PRINTING PRESS WITH COMMON BLANKET CYLINDER

This application is a divisional of U.S. patent application Ser. No. 09/625,623 filed on July 26, 2000 now U.S. Pat. No. 6,474,231.

BACKGROUND OF THE INVENTION

1. Field of the Invention

The present invention relates generally to printing presses and more particularly to a multi-color web printing press with a common blanket cylinder.

2. Background Information

U.S. Pat. No. 5,907,997 purports to disclose a multi-color web printing press having two blanket cylinders. Arranged about each blanket cylinder are four plate cylinders, each plate cylinder for printing one color of a four-color press. The web can be printed either on one side using impression cylinders contacting the blanket cylinders or printed on both sides with each blanket cylinder functioning as the impression cylinder for the other blanket cylinder. The press of the '997 patent has the disadvantage that during a plate change, one side of the web cannot be printed. During a plate change, the printing press therefore cannot be operated, and significant downtime can result.

German Patent Application No. 197 43 770 purports to disclose a sheet-fed printing press with a satellite printing unit 2 with print form cylinders 52, print forms 5, 7, 9, 11, blanket cylinders 50, and an impression cylinder 14. After printing in the satellite print unit 2, a sheet 30 is transferred to a single print print unit 4 where another image is printed. Print unit 4 has print form cylinders 58, blanket cylinders 56 and print forms 49, 51. The print forms 49, 51 are inked by inking units 60. The two print form cylinders may be alternately used. The press disclosed in the German Patent Application No. 197 43 770 has the disadvantage that only one print form 49 or 51 can be changed or processed without stopping the press.

BRIEF SUMMARY OF THE INVENTION

An object of the present invention is to provide a printing press which provides for simple changing of printing forms, including printing plates, even while the press is operating. An alternate or additional object of the present invention is to provide for a common blanket printing press with reduced downtime. Yet another alternate or additional object of the present invention is to reduce the number of components by providing a common blanket cylinder.

The present invention provides a printing press comprising:

- a first print form cylinder;
- a second print form cylinder;
- a first common inking unit for selectively inking the first and second print form cylinders;
- a third print form cylinder;
- a fourth print from cylinder;
- a second common inking unit for selectively inking the third and fourth print form cylinders with an ink color different from the first common inking unit; and
- a common blanket cylinder, the first and third print form cylinders contacting the common blanket cylinder during a first mode of operation and the second and fourth print form cylinders contacting the common blanket cylinder during a second mode of operation.

The present device permits for a change of the print forms on the second and fourth print form cylinders, for example by changing a printing plate, while permitting continued printing by the first and third print form cylinders. When it is desired that the second and fourth print forms begin printing, operation is switched to the second mode and then a print form change on the first and third print form cylinders can occur. Thus, press downtime can be reduced.

The present invention also may further include a fifth, sixth, seventh and eighth print form cylinders, with the fifth and sixth print form cylinders having a third common inking unit, and the seventh and eighth print form cylinder having a fourth common inking unit. Thus, a change of the print forms on the second, fourth, sixth, and eighth print form cylinders, for example by changing printing plates, permits continued printing by the first, third, fifth, and seventh print form cylinders. When desired that the second, fourth, sixth, and eighth print forms begin printing, operation is switched to the second mode and a print form change on the first, third, fifth, and seventh print form cylinders can occur.

Preferably, the blanket cylinder has a gapless blanket, which may be an axially removable blanket. The blanket may be for example a gapless tubular blanket printing blanket as disclosed in U.S. Pat. No. 5,323,702, which is hereby incorporated by reference herein.

The present invention also may provide an impression cylinder. The impression cylinder contacts the blanket cylinder to form a nip, through which the web passes. The blanket thus produces a multi-colored image on the side of the web contacting the blanket.

The present invention also may provide a second impression cylinder and a second blanket. The second impression cylinder contacts the second gapless blanket to form a secondary nip, where a multi-colored image is printed on the side of the web opposite that printed by the first blanket. The second blanket cylinder may work with eight print form cylinders in a similar manner as the first blanket cylinder. The second blanket cylinder may also serve as the first impression cylinder, with separate first and second impression cylinders then no longer being required.

The present invention also provides an image changing device movable between the print form cylinders. The image changing device can then include, for example, laser imager, a cleaning device, and an automatic plate changer with laser-writable plates. Alternatively, the image changing device may include an automatic plate changer for pre-imaged plates.

The image changing device is movable and can preform its respective operations on any print form cylinder in the remote position; hence, the device significantly reduces the downtime of the printing press.

Preferably, two blanket cylinders, one for each side of the web, enable the transfer of multi-color images to both sides of the web.

The present invention also provides a method for printing material comprising the steps of:

- transferring ink from a first inking unit to a blanket cylinder through a first printing form;
- transferring ink from a second inking unit to the blanket cylinder through a third printing form;
- moving the first and third printing forms away from the blanket cylinder;
- transferring ink from the first inking unit to the blanket cylinder through a second printing form; and
- transferring ink from the second inking unit to the blanket cylinder through a fourth printing form.

The method can also be used with an eight print form cylinder configuration.

The present invention also may provide a method for printing on both sides of the web by using an additional blanket and impression cylinder.

Preferably, the present invention also may include a method for laser imaging, post-imaging cleaning, and loading blank plates into the print form cylinders by use of three devices. Alternatively, the method may include automatically loading preimaged plates onto a print form cylinder in the remote position.

The present invention also provides a multi-color printing press comprising a first cylinder set including a first print form cylinder, a second print form cylinder, and at least one inking unit for inking the first and second print form cylinders and a second cylinder set including a third print form cylinder, a fourth print from cylinder, and at least one second inking unit for inking the third and fourth print form cylinders, the at least one second inking unit for inking a color different from the at least first inking unit. A common blanket cylinder is provided with the first and third print form cylinders contacting the common blanket cylinder during a first mode of operation and the second and fourth print form cylinders contacting the common blanket cylinder during a second mode of operation.

For example, rather than having a common inking unit for the first and third print form cylinders, separate inking units could be provided for each of the first and third print form cylinder. Separate inking unit for each of the second and fourth print form cylinders could also be provided. Preferably, the first inking units all ink the same color, and the second inking units all ink a same color different from the same color of the first inking units.

BRIEF DESCRIPTION OF THE DRAWINGS

A preferred embodiment of the present invention is described below by reference to the following drawings, in which.

DETAILED DESCRIPTION

Figure 1:
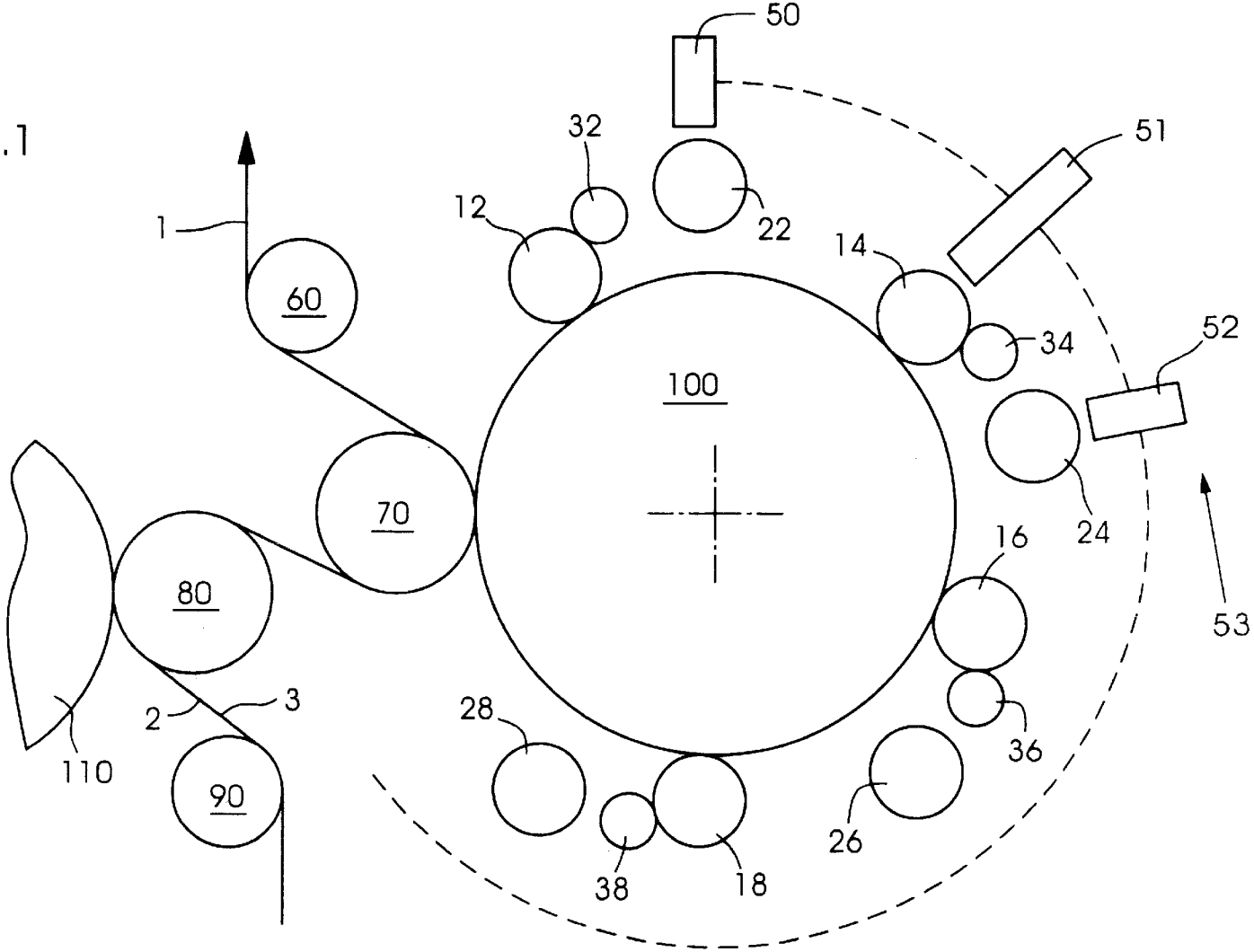
FIG. 1 shows a schematized side view of a printing press according to the present invention in a first mode of operation.
Figure 2:
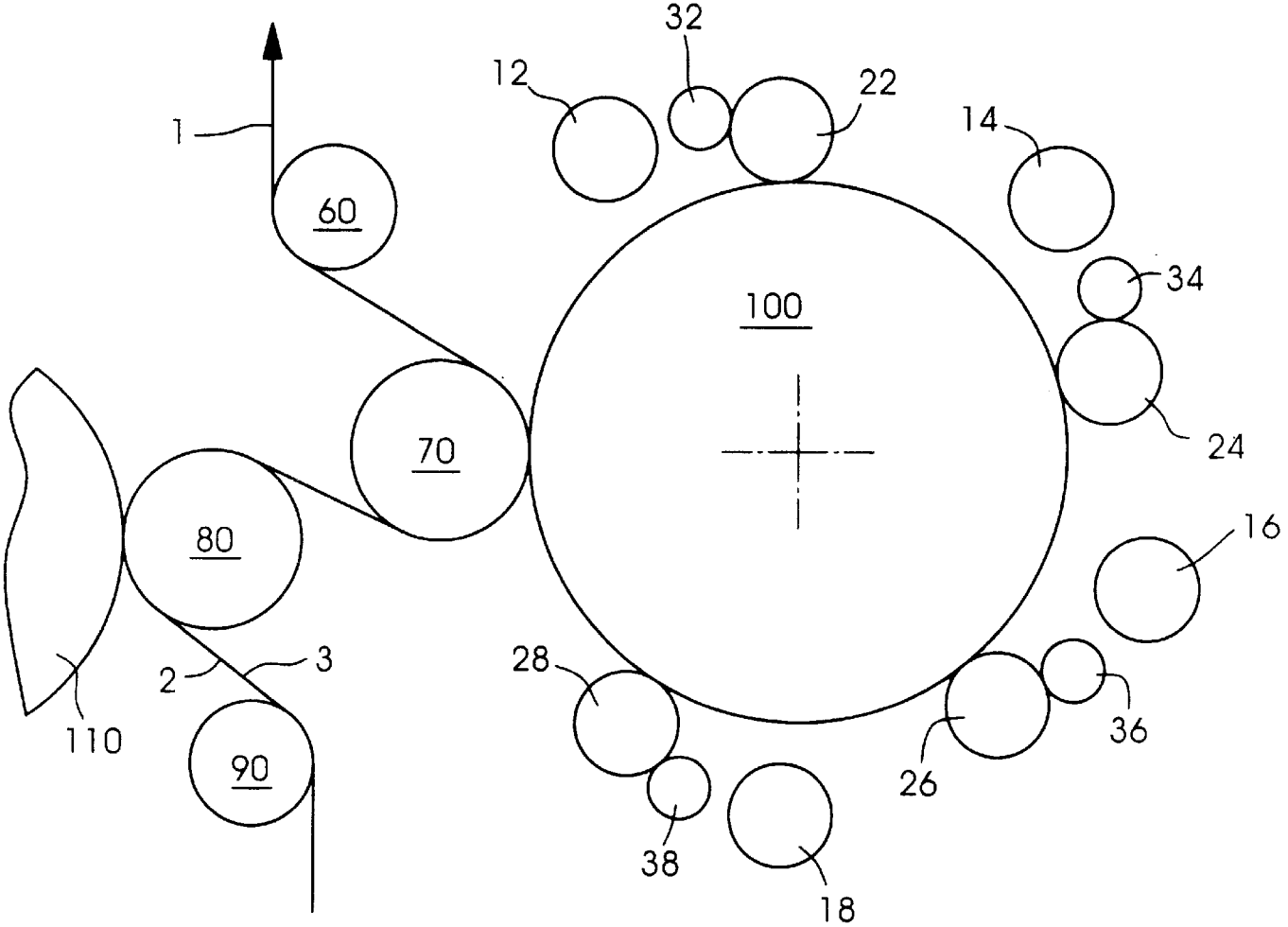
FIG. 2 shows a schematized side view of the printing press of FIG. 1 in a second mode of operation.

FIGS. 1 and 2 show a schematized side view of a preferred embodiment of a multi-color printing press either in its first mode of operation (FIG. 1), or its second mode (FIG. 2).

The press of FIGS. 1 and 2 includes a blanket cylinder 100 and a second blanket cylinder 110, both of which are rotatable in a fixed frame. Blanket cylinder 100 and an impression cylinder 70 form a nip at their contact point for the purpose of printing on a first side 3 of a web 1. A second blanket cylinder 110 and a second impression cylinder 80 form a nip at their contact point for the purpose of printing on a second side 2 of web 1. Impression cylinder 70 and second impression cylinder 80 work in conjunction with two guide rollers 60, 90 to feed the web 1 through the press.

In a first mode of operation (FIG. 1), a plurality of print form cylinders, 12, 14, 16, 18, contact gapless blanket cylinder 100, while a plurality of second print form cylinders 22, 24, 26, 28, are in a remote position. When the press changes from the first mode of operation to a second mode of operation (FIG. 2), the plurality of second print form cylinders, for example four secondary print form cylinders 22, 24, 26, 28, contact gapless blanket cylinder 100, while the plurality of print form cylinders 12, 14, 16, 18, move to the remote position. In the first mode of operation (FIG. 1), four common inking units 32, 34, 36, 38 ink the print form cylinders 12, 14, 16, 18; however, in the second mode of operation (FIG. 2) the common inking units 32, 34, 36, 38 ink the secondary print form cylinders 22, 24, 26, 28. This allows the transfer of a multi-colored image to the gapless blanket cylinder 100 by the four print form cylinders 12, 14, 16, 18, when the press is in the first mode (FIG. 1), and by the secondary print form cylinders 22, 24, 26, 28, when the press is in the second mode (FIG. 2). Inking units 32, 34, 36, 38 may provide for example magenta, yellow, cyan, and black ink to their respective print form cylinders.

During the first mode of operation (FIG. 1), a laser imaging device 50, preimaging cleaning device 51, and blank plate automatic loader device 52, which define an image changing device 53, may perform their operations, which will be explained below, on the secondary print form cylinders 22, 24, 26, 28, which are in a remote position. During the second mode of operation (FIG. 2), the image changing device 53 may perform its operations on the four print form cylinders 12, 14, 16, 18, which are now in the remote position. The two modes allow continuous printing while either the print form cylinders 12, 14, 16, 18 or secondary print form cylinders 22, 24, 26, 28 are supplied with a new image.

The laser imaging device 50, post-imaging device 51, blank plate automatic loader device 52, may be movable to access any print form cylinder 12, 14, 16, 18 or secondary print form cylinder 22, 24, 26, 28 that is located in the remote position. When accessing such cylinders, the blank plate automatic loader device 52 removes an old plate and inserts a new blank laser imageable plate, the laser imaging device 50 creates a new image on the plate, and the post-imaging device cleans the plate of detrius arising from the imaging process. The three devices 50, 51, 52 may move in a circular track and can move aside to permit others to pass.

The print form cylinder 12, 14, 16, 18, secondary print form cylinders 22, 24, 26, 28, common inking units 32, 34, 36, 38, and image changing device 53 can move, for example, hydraulically, pneumatically, or through mechanized gearing, although it should be understood that other methods are also possible.

The print form cylinders could also be directly imageable cylinders without removable plates. The blanket cylinder 100 and second blanket cylinder 110 could form the impression cylinders for each other. Additionally, the image changing device 53 could be a simple plate changer device for a principal plate. While four print form cylinders have been disclosed, it should be understood that the printing press could operate with any amount of print form cylinders greater than two. U.S. Pat. No. 5,907,997 is hereby incorporated by reference herein. The common inking units preferably include a keyless inker and use a single fluid for instantaneous changeover. A cleaning device for the blanket may be located after the impression cylinder and operate intermittently or continuously. Register marks for proper axial web registration may be located and detected on the blanket.

What is claimed is:

1. A method for printing material comprising the steps of:

transferring ink from a first inking unit to a blanket cylinder through a first printing form;

transferring ink from a second inking unit to the blanket cylinder through a third printing form;

moving the first and third printing forms away from the blanket cylinder;

transferring ink from the first inking unit to the blanket cylinder through a second printing form; and transferring ink from the second inking unit to the blanket cylinder through a fourth printing form.

2. The method for printing material as recited in claim 1 further comprising transferring multi-color images from the blanket cylinder to the web at a nip formed by the blanket cylinder and an impression cylinder.

3. The method for printing material as recited in claim 2 further comprising transferring multi-colored images to the opposite side of the web by using a second impression cylinder and a second blanket cylinder.

4. The method for printing material as recited in claim 1 further comprising automatically changing images on the print form cylinders.

* * * * *